United States Patent [19]

Koci et al.

[11] 3,958,548

[45] May 25, 1976

[54] ENGINE WITH DIFFERENTIAL PRESSURE RESPONSIVE PROTECTIVE DEVICE

[75] Inventors: Ludvik F. Koci, La Grange Park; John H. Cryder, Plainfield, both of Ill.

[73] Assignee: General Motors Corporation, Detroit, Mich.

[22] Filed: Dec. 23, 1974

[21] Appl. No.: 535,412

[52] U.S. Cl. ..... 123/198 D; 123/41.15

[51] Int. Cl.[2] ..... F01P 5/14

[58] Field of Search... 123/198 R, 198 DB, 198 DC, 123/198 D, 41.15; 340/59

[56] References Cited

UNITED STATES PATENTS

| | | | |
|---|---|---|---|
| 3,138,144 | 6/1964 | Armbrust | 123/41.15 |
| 3,246,641 | 4/1966 | Goehring | 123/198 DB |
| 3,261,336 | 7/1966 | St. Lucas et al. | 123/41.15 |
| 3,293,390 | 12/1966 | Shaw | 340/59 X |
| 3,293,391 | 12/1966 | Carlson | 340/59 X |
| 3,518,887 | 7/1970 | Armbrust | 123/41.15 X |
| 3,533,391 | 10/1970 | Lockmuller | 123/198 DB |
| 3,763,836 | 10/1973 | Guehr | 123/41.15 |
| 3,817,224 | 6/1974 | Pluequet et al. | 123/41.15 |
| 3,832,982 | 9/1974 | Guehr | 123/198 D X |

*Primary Examiner*—Charles J. Myhre
*Assistant Examiner*—Ira S. Lazarus
*Attorney, Agent, or Firm*—Robert J. Outland

[57] ABSTRACT

An internal combustion engine is provided with an engine driven pump forced cooling system that is closed to permit operation at elevated pressures and temperatures. A protective device is provided to stop or otherwise modify normal engine operation upon a failure of adequate coolant flow. The protective device is made responsive to the difference in coolant pressure between the pump inlet and outlet to eliminate any effect of cooling system pressurization upon the indication of coolant flow. Variations in normal coolant flow with engine speed are accommodated by additional means responsive to pressure in another engine fluid system, such as the air box, where the pressure varies with engine speed, such that reduction of the differential coolant pressure across the pump below a predetermined value relative to engine speed permits actuation of the protective device to stop or modify engine operation.

2 Claims, 3 Drawing Figures

ENGINE WITH DIFFERENTIAL PRESSURE RESPONSIVE PROTECTIVE DEVICE

FIELD OF THE INVENTION

This invention relates to internal combustion engines and more particularly to engines with protective devices for stopping or otherwise modifying engine operation in response to the occurrence of an undesired condition. In particular, the present invention relates to a protective device responsive to differential pressures in the engine cooling system to indicate insufficient coolant flow irrespective of varying pressurization of the cooling system.

BACKGROUND OF THE INVENTION

U.S. Pat. No. 3,246,641 Goehring granted Apr. 19, 1966 and assigned to the assignee of the present invention discloses a combination engine protective device operable to stop operation of an internal combustion engine upon the happening of certain abnormal conditions such as, for example, excessive crankcase or air box pressure or inadequate water pressure in the engine cooling system. The device is operative upon occurrence of any of these abnormal operating conditions to open a valve so as to drain oil from a pressure line connected with the engine governor. The pressure drop in the oil line in turn actuates means in the engine governor to stop operation of the engine.

The water-air box pressure portion of the protective device, as described in column 4 of the Goehring patent, comprises a latching member (sleeve 62) engaged by a pair of diaphragms, one of which is responsive to pressure in the engine cooling system to urge the member toward its "latch" position and the other of which is responsive to pressure in the engine air box to urge the member toward its "release" position. In normal engine operation, the pressures in both the cooling system and the air box vary as functions of engine speed and so tend to offset one another. If, however, the engine water pressure is reduced or the air box pressure is increased an abnormal amount, the latching member is moved to its "release" position, tripping the protection device and stopping the engine.

Engine protective devices of the type disclosed in the above-cited patent have been satisfactorily used in many engine applications, particularly on diesel engines applied to railroad locomotives. In the past, the cooling system of such engines has generally been provided with a vent to atmosphere in order to maintain a relatively constant pressure level in certain portions of the cooling system, such as at the pump inlet. Currently, however, it has become common practice to close the cooling system vent by applying a pressure cap and providing the system with a pressure relief valve so that the cooling system may be pressurized up to a predetermined level. This permits operation at higher coolant temperatures without causing cavitation of coolant in the pump which sometimes causes inadequate coolant flow through the engine.

The protective device of the above-cited patent has been satisfactorily operated with both types of cooling systems. However, it has been found that, with closed cooling systems, the system may be pressurized to such an extent that the pump outlet pressure sensed by the protective device will remain high enough to keep the device in its latched position. In such an instance, the protective device will not shut down the engine, even though cooling water flow through the engine becomes inadequate for its continued operation at normal temperatures.

SUMMARY OF THE INVENTION

The present invention constitutes an improvement of the engine and protective device arrangement disclosed in the above-cited U.S. Pat. No. 3,246,641. The improved arrangement overcomes the problem created by varying pressurization of engine cooling systems and provide a modified arrangement of engine protective device which responds to inadequate engine cooling water flow relative to engine operating speed irrespective of the effect of pressurization of the cooling system.

The varying pressurization effects are eliminated by utilizing, as an indication of water flow through the system, the difference in the cooling system pressures on the outlet and inlet sides of the engine driven coolant pump. This differential pressure, which normally varies as a function of engine speed, is preferably balanced against engine air box pressure such that upon excessive reduction of the differential pressure, indicating inadequate coolant flow in the engine cooling system, the protective device will be tripped by the engine air box pressure acting upon the latching means in the protective device.

If desired, it would of course be possible to replace the bias of the engine air box pressure in the protective device with some other fluid source or another type of biasing means which is variable in response to changes in engine speed. Furthermore, in some engine applications wherein the engine normally operates with minimum speed differentials, a constant biasing force, provided for example by a spring, might be used in place of biasing means having a force variable in proportion to engine speed. As an alternative, it would be possible in some circumstances to provide diaphragm means of differing sizes and arranged to be acted upon by the pump inlet and outlet coolant pressures such that reduction of the pressure differential below a predetermined value would cause movement of the latching means without the necessity of utilizing any biasing means in conjunction therewith.

The foregoing and other features and advantages of the invention will be more fully understood from the following description of a preferred embodiment of the invention, taken together with the accompanying drawings.

BRIEF DESCRIPTION OF THE DRAWING

In the drawing:

FIG. 1 is a schematic representation of an internal combustion engine having a pressurized cooling system and engine protective means formed in accordance with this invention;

DESCRIPTION OF THE PREFERRED EMBODIMENT

Figure 2:
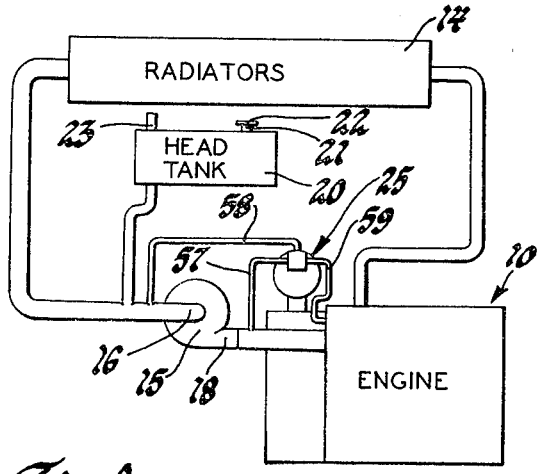
FIG. 2 is an end view of an engine showing the application of an improved engine protective device in accordance with the invention.
Figure 2:
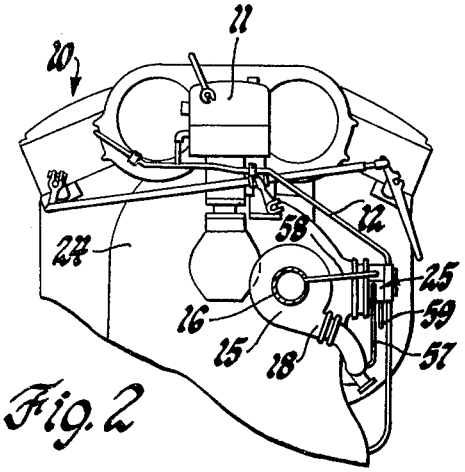

Referring first to FIGS. 1 and 2 of the drawing, there is shown an internal combustion engine generally indicated by numeral 10. Engine 10 mounts a governor 11 that includes a mechanism for controlling and stopping the engine, the latter being operated by a reduction of oil pressure in an oil pressure line 12 connected with the governor and with other portions of the engine oil supply system, not shown.

The engine also includes a cooling system having internal passages, not shown, which are connected externally in a closed loop through cooling radiators 14 and a water pump or coolant pump 15. The pump 15 is mounted on the engine and is driven thereby at a speed varying proportionally to engine speed. Pump 15 has an inlet 16, connected to receive cool water or other liquid coolant from the radiators, and an outlet 18, connected to deliver the coolant under pressure to the engine.

The cooling system further includes a head tank 20 connected with the cooling system on the inlet side of the pump so as to provide a head of cooling water that normally maintains a positive pressure on the pump inlet. The head tank is provided with a filler opening 21 closed by a pressure cap 22 to permit the cooling system to be pressured. A pressure relief valve 23 is also provided in the system to relieve pressures in excess of a predetermined maximum.

Engine 10 is also provided with an accessory housing 24 on which is mounted an engine protective device 25 in accordance with the present invention. The protective device 25 is of generally similar construction to the devices disclosed in the above-mentioned U.S. Pat. No. 3,246,641 in that it includes a crankcase pressure responsive diaphragm 27 that controls a release mechanism 28. Upon occurrance of excessive crankcase pressure, mechanism 28 releases a spring biased valve 30, allowing it to open and drain oil from a valve body 31 connected with the engine oil line 12. This results in a pressure reduction in the oil line 12 which is sensed by the governor, actuating its shutdown mechanism and stopping the engine.

The protective device 25 is also provided with a coolant protection portion 32 having improved features in accordance with the present invention. Portion 32 includes a spring biased valve 34 reciprocably carried in the valve body 31 and having a protruding stem 35 provided with a latching groove 36. Stem 35 is received within a flanged sleeve 38 carried within a multi-piece housing 40 that is secured to the valve body 31. The sleeve 38 retains a plurality of latching balls 41 that are engageable with the groove 36 to maintain the valve 34 in its closed position.

Within the housing 40 there is disposed a reciprocably movable assembly 42 which carries a latching sleeve 44 and four spaced diaphragms 45, 46, 47, 48. The diaphragms are secured within the housing 40 and divide the interior thereof into five separate chambers, 51–55. Chambers 52 and 54 are connected with atmosphere. Chamber 51 is connected through an external tube 57 with the engine cooling system adjacent the coolant pump outlet. Chamber 53 is connected through a tube 58 with the engine cooling system adjacent the coolant pump inlet. Chamber 55 is connected through a tube 59 with the engine air box, not shown, formed internally of the engine.

In operation the engine drives the water pump 15 at a speed proportional to engine speed. The pump raises the coolant pressure on its outlet side relative to that on its inlet, causing circulation of the coolant through the engine and radiators in a closed loop returning to the pump inlet. As engine speed is increased, the outlet pressure of the pump increases, as does the differential pressure between its outlet and inlet.

As the engine coolant temperatures increases, vaporization of some of the coolant will pressurize the entire system up to the maximum permitted by the pressure relief valve 23. When the system is pressurized, both the pump inlet and outlet pressures are increased, but the differential pressure across the pump remains unaffected by such pressurization. Thus, the differential pump pressure indicates the amount of coolant flow actually passing through the cooling system and normally varies as a predetermined function of engine speed.

Figure 3:
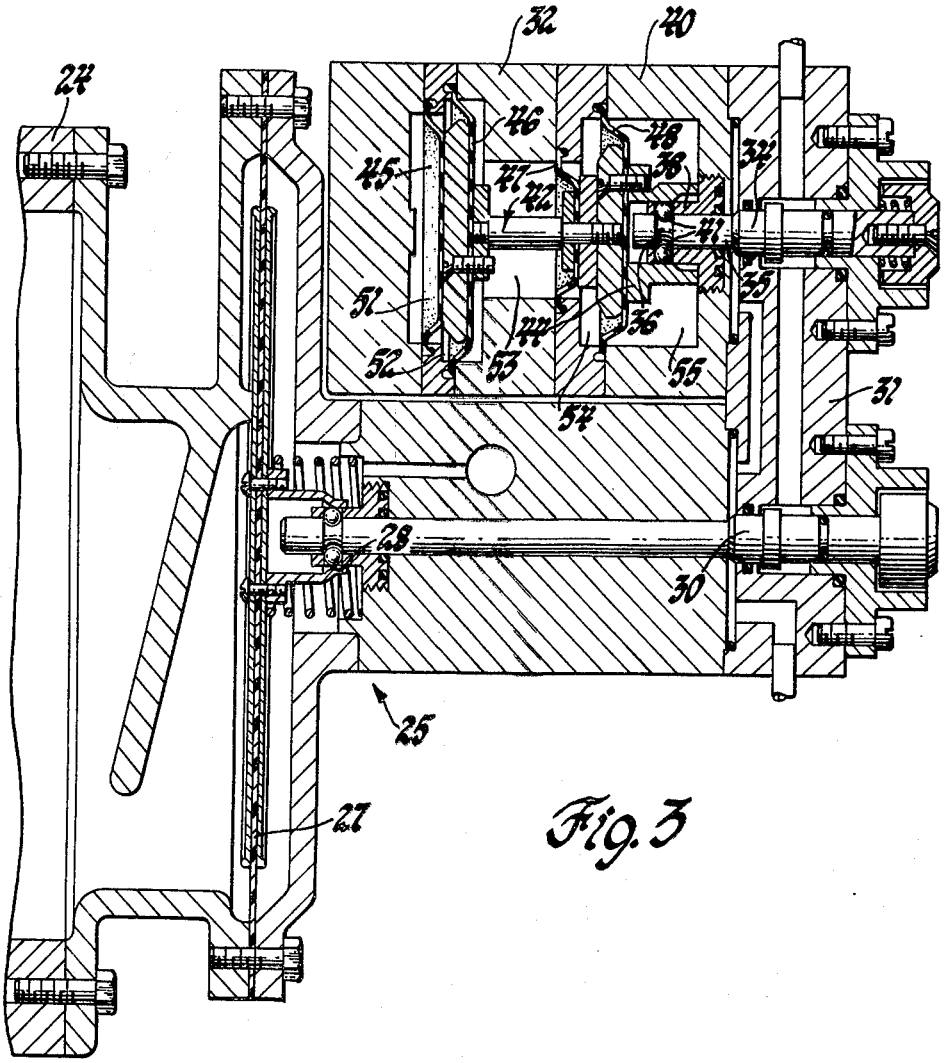
FIG. 3 is a cross sectional view showing the internal construction of the improved engine protective device applied to the engine of FIG. 2.

The charging pressure in the engine air box, which is provided in known manner by an engine driven pump or blower or an exhaust driven supercharger, also increases generally in proportion to engine speed in much the same manner as does the differential pressure across the water pump. Accordingly, member 42 is acted upon during engine operation by three pressures, each of which is normally variable with engine speed. The coolant pressure at the water pump outlet acts against diaphragm 45, urging member 42 rightwardly as shown in FIG. 3. The coolant pressure at the pump inlet acts against diaphragms 46 and 47, but since diaphragm 46 is larger, this pressure effectively urges member 42 leftwardly as shown in FIG. 3. This leftward bias is supplemented by engine air box pressure acting against diaphragm 48.

The difference between the oppositely acting forces of the water pump outlet and inlet pressures acting on member 42 constitutes a measurement of the differential pressure across the pump which is representative of actual water or other coolant flow through the cooling system, irrespective of pressurization which exists in the overall system. Member 42 and its diaphragms are sized such that under normal operating conditions the force caused by this differential pressure is sufficiently great to overcome the force created by the engine air box pressure which biases the member 42 leftwardly. Accordingly, in normal operation member 42 is held in its rightward position, as shown in FIG. 3, by the force of the differential pressure across the coolant pump, thereby causing sleeve 44 to maintain the latching balls 41 in the groove 36 and hold the valve 34 in its closed position. If, however, due to increasing temperature or other reason, cavitation, a loss of cooling water in the cooling system, or some other cause should result in an excessive reduction of cooling water flow through the pump, the differential between the pump outlet and inlet pressures will be substantially reduced to the point where the resultant force of these differential pressures on member 42 is less than that caused by the engine air box pressure. In this condition member 42 will be moved leftwardly, releasing the latching balls 41 and permitting the valve 34 to open. This action will then drain the oil from line 12 and actuate the governor shutdown mechanism, stopping the engine.

While the invention has been described by reference to a preferred embodiment, it should be apparent that numerous changes could be made within the scope of the inventive concepts disclosed. As an example, it would be possible to modify the valve construction by placing a biasing spring within the housing 32 to urge the member 42 in one or the other direction, in order to properly balance the forces acting on this member for the conditions provided. In addition, various modifications in the diaphragm arrangements or substitution of other types of biasing or pressure responsive devices could be made. In view of these and other changes that will be apparent to those skilled in the art, it is intended that the invention not be limited, except by the language of the following claims.

What is claimed is:

1. An internal combustion engine having a closed pressurizable liquid cooling system, an engine driven pump having an inlet and an outlet and connected in said cooling system to circulate liquid coolant therethrough by increasing the pressure in said pump outlet relative to that in said pump inlet, the pressure differential between said outlet and inlet normally varying as a function of engine speed, and engine protective means comprising engine shutdown means actuatable to modify normal operation of said engine, differential pressure means operable by said differential pressure between said pump outlet and inlet to oppose actuation of said shutdown means with a force proportional to said differential pressure, and variable biasing means effective to oppose the force of said differential pressure means with a force varying generally as a function of engine speed and of magnitude less than the force of said differential pressure means when the pump inlet and outlet pressure differential remains above a normal value in relation to engine speed but greater than the force of said differential pressure means when said differential pressure falls below a predetermined normal value in relation to engine speed, thereby offsetting the force of said differential pressure means and allowing actuation of said shutdown means by said biasing means.

2. An internal combustion engine having a closed pressurizable liquid cooling system, an engine driven pump having an inlet and an outlet and connected in said cooling system to circulate liquid coolant therethrough by increasing the pressure in said pump outlet relative to that in said pump inlet, the pressure differential between said outlet and inlet normally varying as a function of engine speed, a second fluid system in said engine and normally operating at a pressure varying as a function of engine speed, and engine protective means comprising engine shutdown means including a first member having a set position wherein normal operation of said engine is permitted and movable to a tripped position wherein said protective means is actuated to prevent normal operation of said engine, a second member movable between a latched position wherein said second member maintains said first member in its set position and a released position wherein said first member is allowed to move to its tripped position, means biasing said first member toward its tripped position, and first, second and third pressure responsive means acting on said second member, said first means being connected with said pump outlet and responsive to coolant pressure therein to urge said second member toward its latched position, said second means being connected with said pump inlet and responsive to coolant pressure therein to urge said second member toward its released position, and said third means being connected with said second fluid system and responsive to pressure therein to urge said second member toward its released position, the forces of said first, second and third means on said second member being related to the pressures in said cooling and second fluid systems such that said second member is urged toward its latched position during normal engine operation but is moved to its released position upon reduction of the pressure differential between said pump inlet and outlet to an abnormally low value in relation to engine speed.

* * * * *